US007744447B2

(12) United States Patent
Kodani et al.

(10) Patent No.: US 7,744,447 B2
(45) Date of Patent: Jun. 29, 2010

(54) ABRASIVE DISC

(75) Inventors: Noriomi Kodani, Hiroshima (JP); Akihiko Nagaya, Tokyo (JP); Katsuhiro Kawasaki, Kyoto (JP)

(73) Assignee: Goei, Co., Ltd., Hiroshima (JP)

( * ) Notice: Subject to any disclaimer, the term of this patent is extended or adjusted under 35 U.S.C. 154(b) by 0 days.

(21) Appl. No.: 11/080,981

(22) Filed: Mar. 16, 2005

(65) Prior Publication Data

US 2006/0211353 A1 Sep. 21, 2006

(51) Int. Cl.
*B23F 21/03* (2006.01)

(52) U.S. Cl. ..... 451/548; 451/259; 451/359; 451/529; 451/533; 451/537; 451/541

(58) Field of Classification Search ..... 451/548, 451/259, 359, 529, 533, 537, 508, 541–543
See application file for complete search history.

(56) References Cited

U.S. PATENT DOCUMENTS

| | | | | |
|---|---|---|---|---|
| 2,442,129 | A * | 5/1948 | Hollstrom | 451/548 |
| 3,086,277 | A * | 4/1963 | Hardy | 407/29.13 |
| 3,498,010 | A * | 3/1970 | Hagihara | 451/527 |
| 3,548,264 | A * | 12/1970 | Bainbridge et al. | 361/520 |
| 3,844,072 | A * | 10/1974 | Haigh et al. | 451/510 |
| 4,536,912 | A * | 8/1985 | Malish | 15/246 |
| 5,083,839 | A * | 1/1992 | Younger | 299/39.8 |
| 5,272,845 | A * | 12/1993 | Burkley | 451/496 |
| 5,468,178 | A * | 11/1995 | Kitko et al. | 451/548 |
| 5,567,503 | A * | 10/1996 | Sexton et al. | 428/143 |
| 5,586,930 | A * | 12/1996 | Hayashi et al. | 451/548 |
| 5,752,876 | A * | 5/1998 | Hettes | 451/463 |
| 6,024,635 | A * | 2/2000 | Cruickshank et al. | 451/541 |
| 6,196,871 | B1 * | 3/2001 | Szu | 439/571 |
| 6,332,832 | B1 * | 12/2001 | Suzuki | 451/41 |
| 6,453,899 | B1 * | 9/2002 | Tselesin | 125/15 |
| 6,949,012 | B2 * | 9/2005 | Barnett, III | 451/56 |
| 6,951,509 | B1 * | 10/2005 | Palmgren | 451/56 |
| 2001/0025457 | A1 * | 10/2001 | Tselesin | 51/293 |
| 2005/0108948 | A1 * | 5/2005 | Sung | 51/307 |

FOREIGN PATENT DOCUMENTS

| | | |
|---|---|---|
| JP | S55-179758 | 6/1954 |
| JP | S60-66451 | 5/1985 |
| JP | S60-161547 | 10/1985 |
| JP | 63-193655 | 12/1988 |
| JP | H07-7859 | 2/1995 |
| JP | 07-40069 | 7/1995 |
| JP | 08-126964 | 5/1996 |
| JP | 11-188642 | 7/1999 |
| JP | 11-300625 | 11/1999 |
| JP | 2000-210866 | 8/2000 |
| JP | 2001-260037 | 9/2001 |
| JP | 2002-321173 | 11/2002 |

* cited by examiner

*Primary Examiner*—Joseph J Hail, III
*Assistant Examiner*—Robert Scruggs
(74) *Attorney, Agent, or Firm*—Berenato & White, LLC

(57) ABSTRACT

An abrasive disc comprises a disc substrate having a peripheral portion, plural abrasive chips each having an abrasive layer on a metal piece and being arranged in the peripheral portion of the disc substrate with a predetermined space, a suspension plate placed between the disc substrate and abrasive chips, and an elastic sheet placed between the disc substrate and the suspension plate so as to isolate the disc substrate from the suspension plate in order to absorb mechanical shock generated in operation of the abrasive disc. The abrasive chips are fastened to the suspension plate. Each of the abrasive chips has abrasive surfaces including a top abrasive surface and peripheral surfaces and the outer peripheral portion and the inner peripheral portion are declined to the top surface.

19 Claims, 16 Drawing Sheets

1: Abrasive Disc
2: Substrate
4: Suspension Plate
5: Abrasive Chip
5a: Forward Edge
5b: First Slant Arm
5c: Backward Edge
51: Abradant Layer
D: Abrasive

ABRASIVE DISC

FIELD OF INVENTION

The present invention relates to a disc which has a capability to ablate the coating layer coated onto the surface of the hard materials, remove rusts or stains covering the metal surfaces or abrade metal surfaces, metal rods, structured materials made of concrete, etc.

It has been well known that a diamond abrasive disc has been used for abrasive disc for abrasion tools. A metal-bonded diamond abrasive disc that has diamond abrasive bound by metal powder, both of which are sintered onto the disc surface and a diamond deposition abrasive disc manufactured by electric deposition bonding have been used for the diamond abrasive discs.

Many of the conventional diamond abrasive discs are formed with a planer metal disc substrate on which abrasive layers are directly made (as described, for instance, in the reference 1).

Since grooves are made on the abrasive discs, the abrasive layers which have function to abrade objects, called abrasive chips, are formed into fan shapes and arranged on the disc substrate with a predetermined interval along the circumferences. The abrasive chips are pasted onto the disc substrate with adhesive.

Mounting grooves are further formed in the radial direction or circumferential direction on the disc substrate and the abrasive chips are fixed in the mounting grooves with a plastic resin.

Reference 1:

pp. 2-3 and FIG. 1-3, Japanese Laid-Open Application, H11-188642, A (1999)

For the conventional diamond abrasive disc disclosed in the reference 1, the abrasive chips are merely mounted and fixed on the metal disc substrate with an adhesive. There is a problem that the centrifugal force and mechanical vibration and shocks are generated to the abrasive chips to be ablated from the disc substrate when the disc substrate is rotated in a high speed to abrade the objects to be abraded. When the abrasive chips are stripped off from the abrasive disc, then it is scattered and may injure the operator or damage the object.

For the diamond abrasive disc, the abrasive chips are attached onto the planar surface of the disc substrate which is made from aluminum plate or steel plate. The annular substrate has lack of elasticity due to the material characteristics. Therefore it is difficult to use the diamond abrasive disc to abrade the curved surface. Since the diamond abrasive disc does not elastically conform to meet the curved surface of the objects due to the hardness of the disc substrate, the uniformly tight contact between the diamond abrasive disc and the object is hardly obtained and therefore it is not possible to obtain the smoothened surface of such curved surface in the abrasion.

Due to the hardness of the metal disc substrate, it is not possible to absorb the abrading force applied to the surface of the object by the elasticity of the metal disc substrate and the grinding tracks due to over-abrasion or the lack of smoothening are often made and left on the surface of the object.

When the operation by moving the abrasive disc back and forth on the planar surface or curved surface of the objects, the sides of the abrasive chips touch with the surface of the object and the sides of the abrasive chips which are fixed onto the disc substrate by the adhesive are first worn out and taken off from the disc substrate, which results into the shortening of the life of the abrasive disc.

The abrasive disc of the present invention further has other abrasive chips, each of which abrasive chips has abrasive surfaces including a top abrasive surface and peripheral surfaces, which are the outer peripheral portion and the inner peripheral portion of the abrasive layer of the abrasive chip. The outer peripheral portion and the inner peripheral portion are declined to the top surface.

According to the declined portion of the abrasive layer of the abrasive chip, the abrasive chip is hardly taken off from the disc substrate since the peripheral edges of the abrasive chip are hardly caught by the stub on the surface to be abraded.

The problems to be solved by the present invention are to provide an abrasive disc of which abrasive surface touches smoothly the surface of the object and the abrasive chips are not easily taken off from the abrasive disc surface. Another purpose of the present invention is to provide bonding metals for the fabrication of the abrasive chips so that the cuttings or debris generated by the abrasion hardly stick onto the abrasive chip surfaces. The other purpose of the present invention is to provide a combination of different abrasive chips fabricated by different bonding metals for the fabrication of the abrasive chips. All of these features contribute to the substantial technical problem to maintain high speed abrasion and long life in use of abrasion operation.

BRIEF SUMMARY OF THE INVENTION

In order to solve the above problem, an abrasive disc has a feature in an alignment of the abrasive chips which are structured with metal pieces, each of which pieces have an abrasive layer, and placed in a predetermined interval on a disc substrate in an annular shape. The abrasive disc has further features that the disc substrate is made of the flexible resin, a flexible suspension plate made of a metal, an abrasive chip which has one or more stakes which are inserted into holes made in the suspension plate and a piece of elastic sheet placed between the disc substrate and the suspension plate.

According to the presence of the elastic sheet between the disc substrate and the suspension plate, the heads of the stakes formed by the plastic deformation, which slightly comes out from the back surface of the suspension plate, sink into the elastic sheet. Therefore the suspension plate is firmly and homogenously contacted to the disc substrate via the elastic sheet and the fixing strength of the adhesive chips to the disc substrate is maintained. The suspension plate is hard to be taken off under abrasion.

When the abrasive disc abrades the object in high-speed disc rotation, the disc substrate, the suspension plate and the elastic sheet are deformed to be always contacted in compliance to the surface of the objects.

The abrasive disc keeps the firm fixing of the abrasive chips in a construction that the abrasive chips are staked by the stakes and that the metal material exists on the suspension. The firm fixing is maintained even when the shape of the disc substrate is elastically deformed to be compliant to the surface of the object in high-speed rotation. The centrifugal force is generated so that the abrasive chips are easily taken off.

The elastic sheet and the disc substrate which has flexibility characteristics provide the cushion characteristics over the abrasive chips and the whole abrasive disc. Therefore, the abrasive chip elastically contacts with the surface of the object to be abraded and smooth abrasion can be carried out.

The each abrasive chip is independently contacted in compliance to the surface of the object to be abraded. Therefore, the object and the surface are elastically contacted and the surface of the object is smoothly finished.

The abrasive disc may preferably comprise the abrasive chips that have a specific shape to smoothly abrade the object. A forward edge of an abrasive chip and the backward edge of a forward adjacent abrasive chip are declined to a radial line so that the radial line crosses both the forward edge of an abrasive chip and the backward edge of another abrasive chip facing to the abrasive chips. In other words, the forward edge and the backward edge of these two adjacent abrasive chips are partly overlapped in the radial projection direction.

In such further abrasive chips regarding the present invention, the forward edge of the abrasive chip first contacts with the object and the forward edge of the next (in other words, the second) abrasive chip contacts before the backward edge of the first chip is detached from the object. In the next moment, the forward edge of the third abrasive chip contacts before the backward edge of the second chip is detached from the object.

A sequential alternation of the contacting and the detaching of these abrasive chips continues in the rotation of the abrasive disc. Therefore it hardly happens that the forward edges of the chips hit the surface of the object while the abrasion is carried out.

The abrasive disc of the present invention further has other abrasive chips, each of which abrasive chips has abrasive surfaces including a top abrasive surface and peripheral surfaces, which are the outer peripheral portion and the inner peripheral portion of the abrasive layer of the abrasive chip. The outer peripheral portion and the inner peripheral portion are declined to the top surface.

According to the declined portion of the abrasive layer of the abrasive chip, the abrasive chip is hardly taken off from the disc substrate since the peripheral edges of the abrasive chip are hardly caught by the stub on the surface to be abraded.

DETAILED DESCRIPTION OF THE INVENTION

Figure 1:
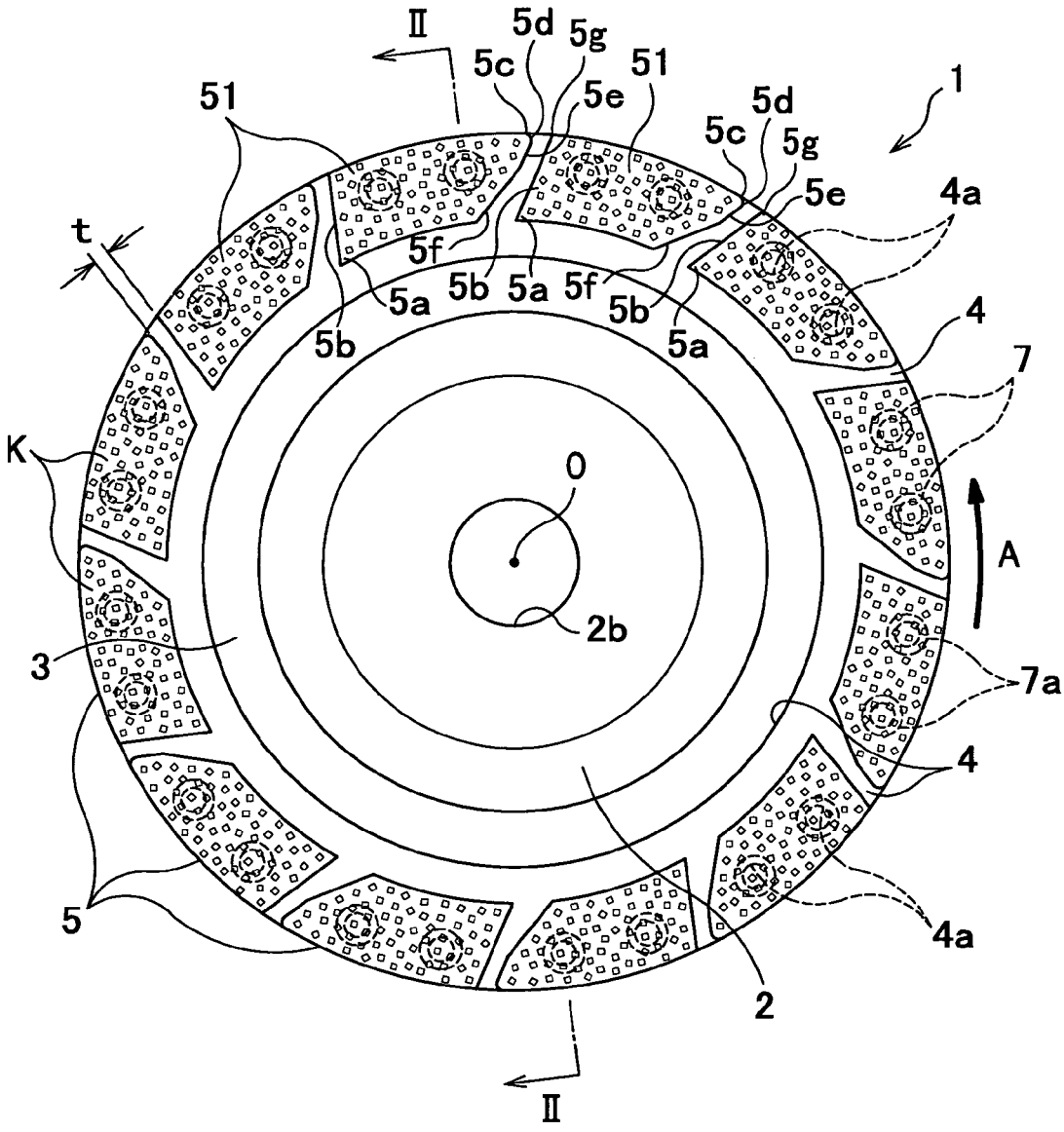
FIG. 1 is a schematic that shows a plan view of an abrasive disc.

In reference to the attached drawings, the present invention is explained in details as follows.

The definition of "upper" is that the upper direction when the disc substrate is placed such a way that the fixing hole is set in the horizontal plane the surface of the abrasive chips are facing to the upward. The definition of "lower" is that the lower direction when the disc substrate is placed such a way that the fixing hole is set in the horizontal plane the tail surface of the abrasive chips are directing to the downward. The upper direction and the lower direction direct various directions in accordance to the abrasive disc setting direction and orientation.

It should be notified that the same numeric figures and letters are used for the elements and components in the drawings for the purpose that the repeated explanations for the elements and the components are avoided.

Figure 2:
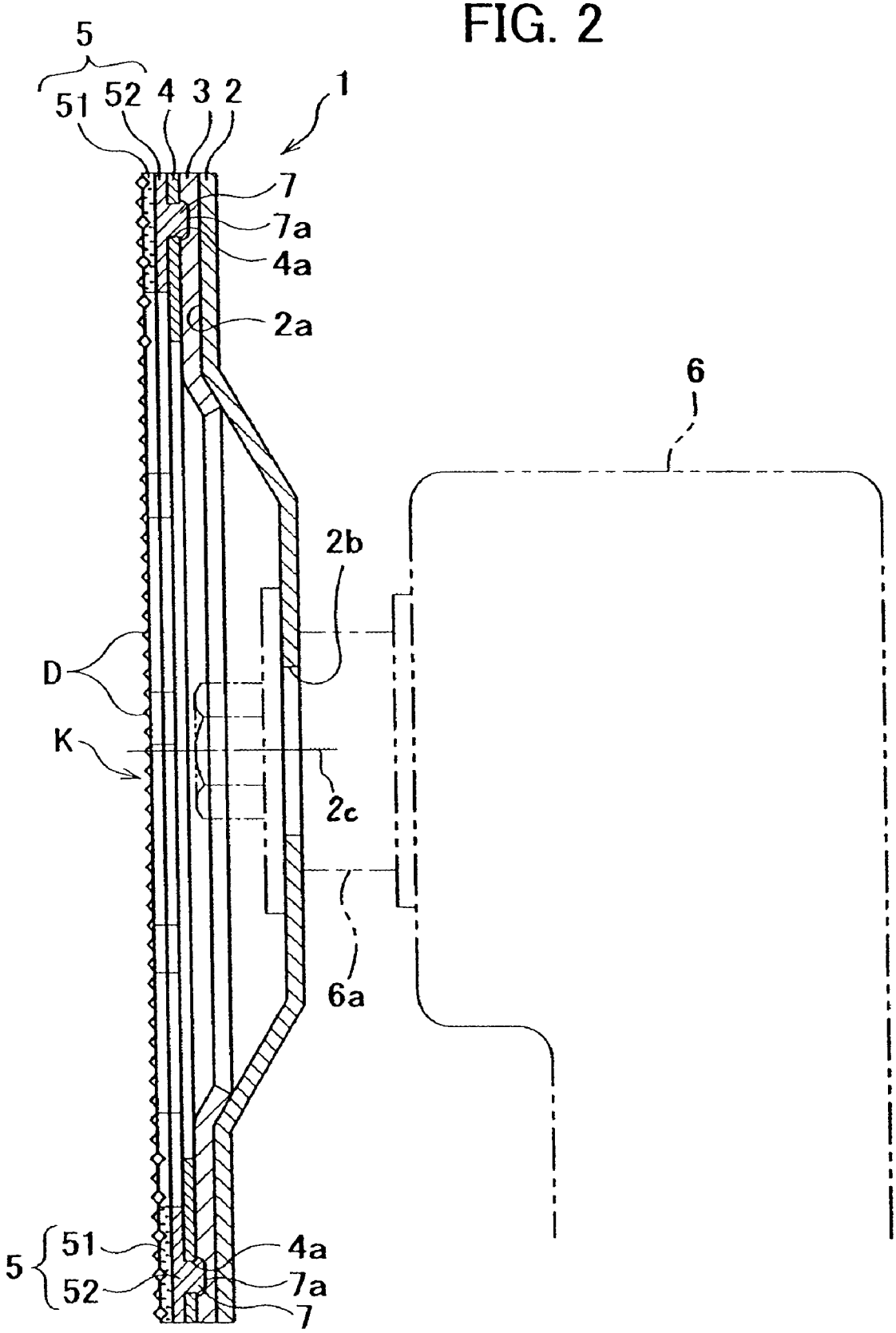
FIG. 2 is a schematic that shows a cross sectional view cut in a II-II line of the abrasive disc shown in FIG. 1.
Figure 3A:
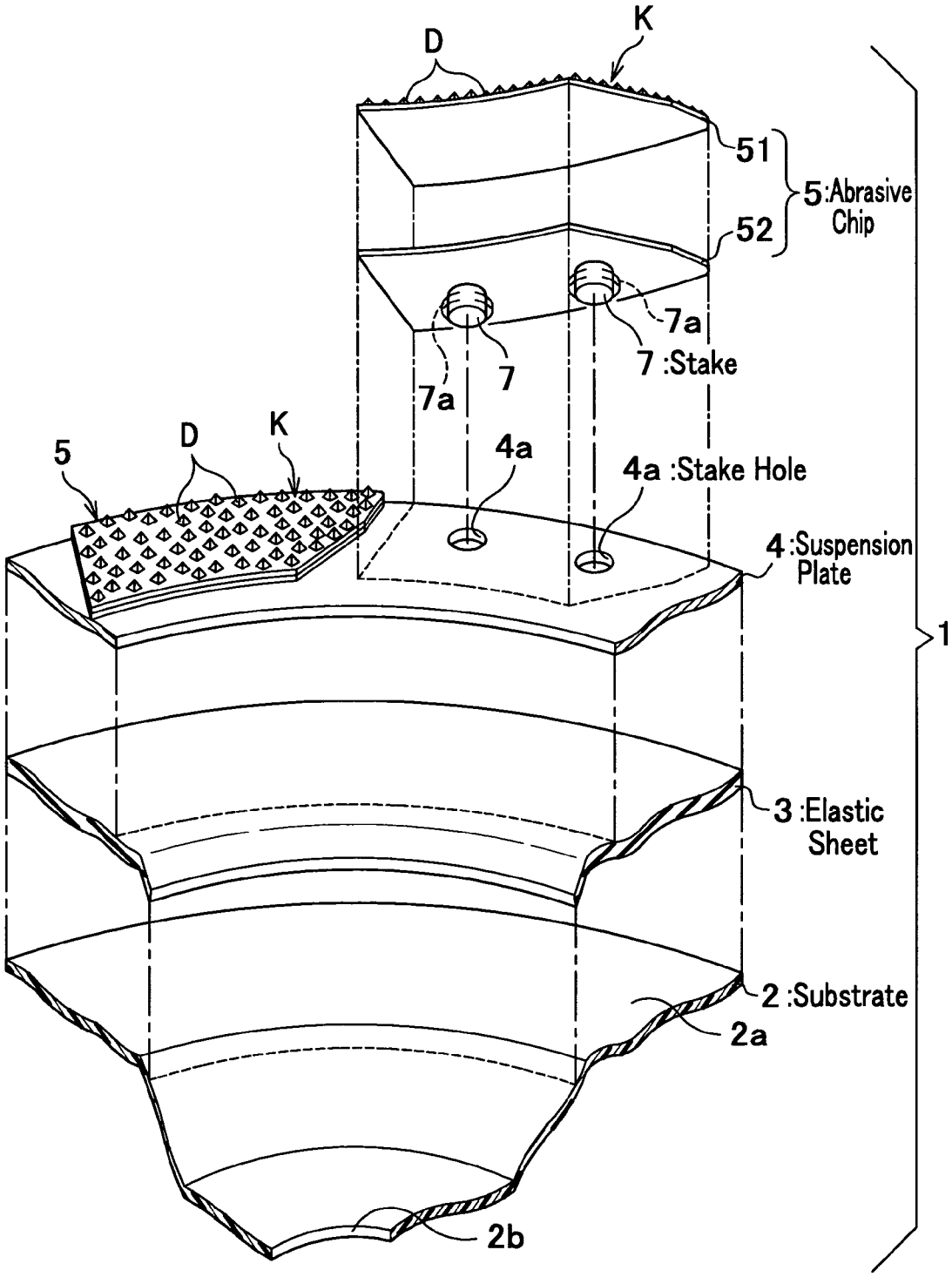
FIG. 3A is a schematic that shows a perspective view of a disassembly of the elemental part of the abrasive disc.

FIG. 1 is a schematic that shows a plan view of an abrasive disc, FIG. 2 is a schematic that shows a cross sectional view cut in II-II plane and FIG. 3A is a schematic that shows the perspective view of a disassembly of the elemental part of the abrasive disc.

As shown in FIG. 2, the abrasive disc 1 is set to an abrasion tool in the form of a grinder 6 which has a rotation capability and other capabilities to ablate a deposition layer painted on the surface of the hard material, remove the rust gathered on the metal surface, make chamfer of the bodies which have keen edges and carry out debris-remove of the object B (see FIG. 6) such as metal plates and rods as cut, ceramics and engineering plastics to be ablated. The abrasive disc comprises a rigid disc substrate 2 which substantially has a saucer-shape, an elastic sheet 3 fixed on a substantially planar, or flat, annular stage 2*a* of the disc substrate 2, a substantially planar suspension plate 4 put on the elastic sheet, abrasive chips 5 and stakes 7 that fix the abrasive chips 5 to the suspension plate 4.

Figure 6A:
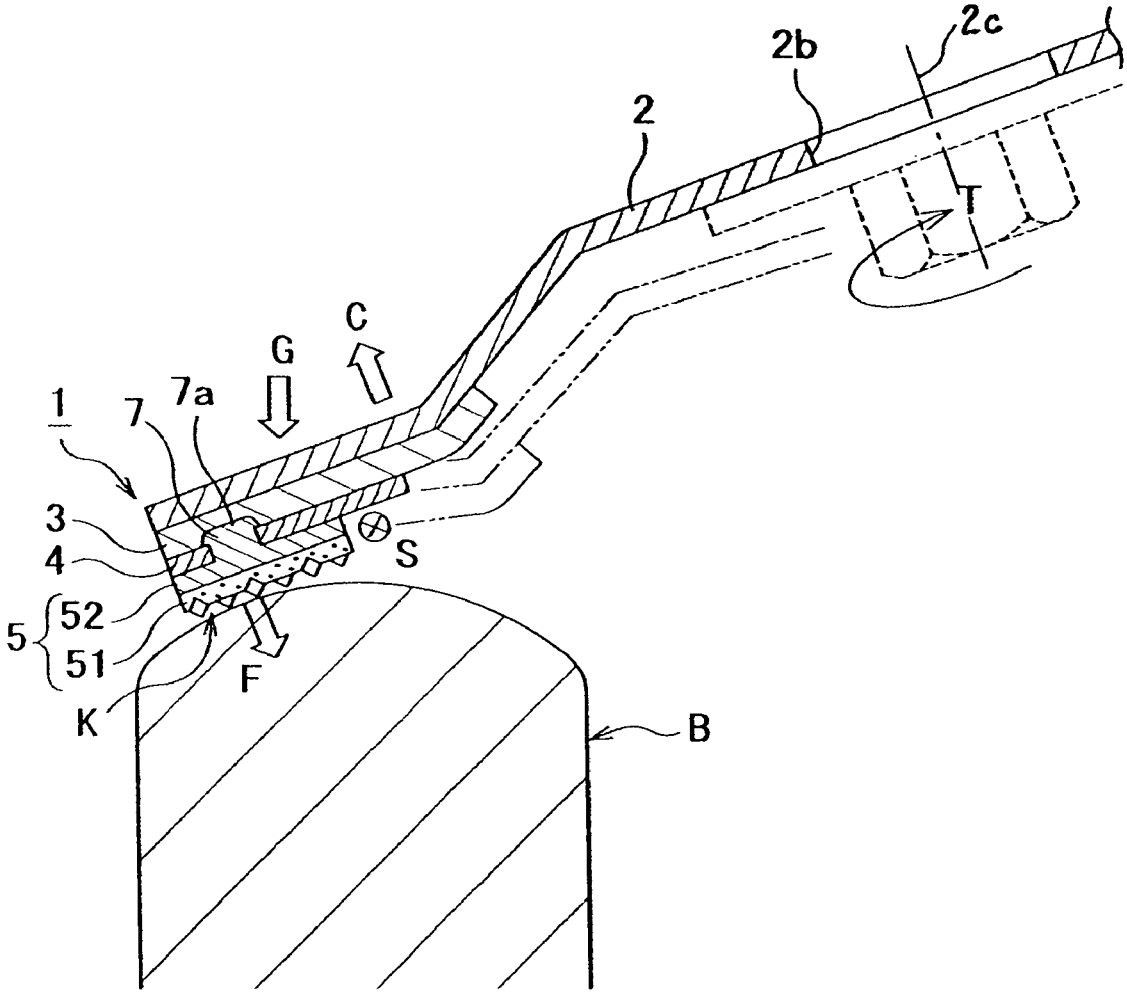
FIG. 6A is a schematic that shows a zoomed-in view of the elemental part of an embodiment of the abrasive disc which is under abrasion operation.
Figure 6B:
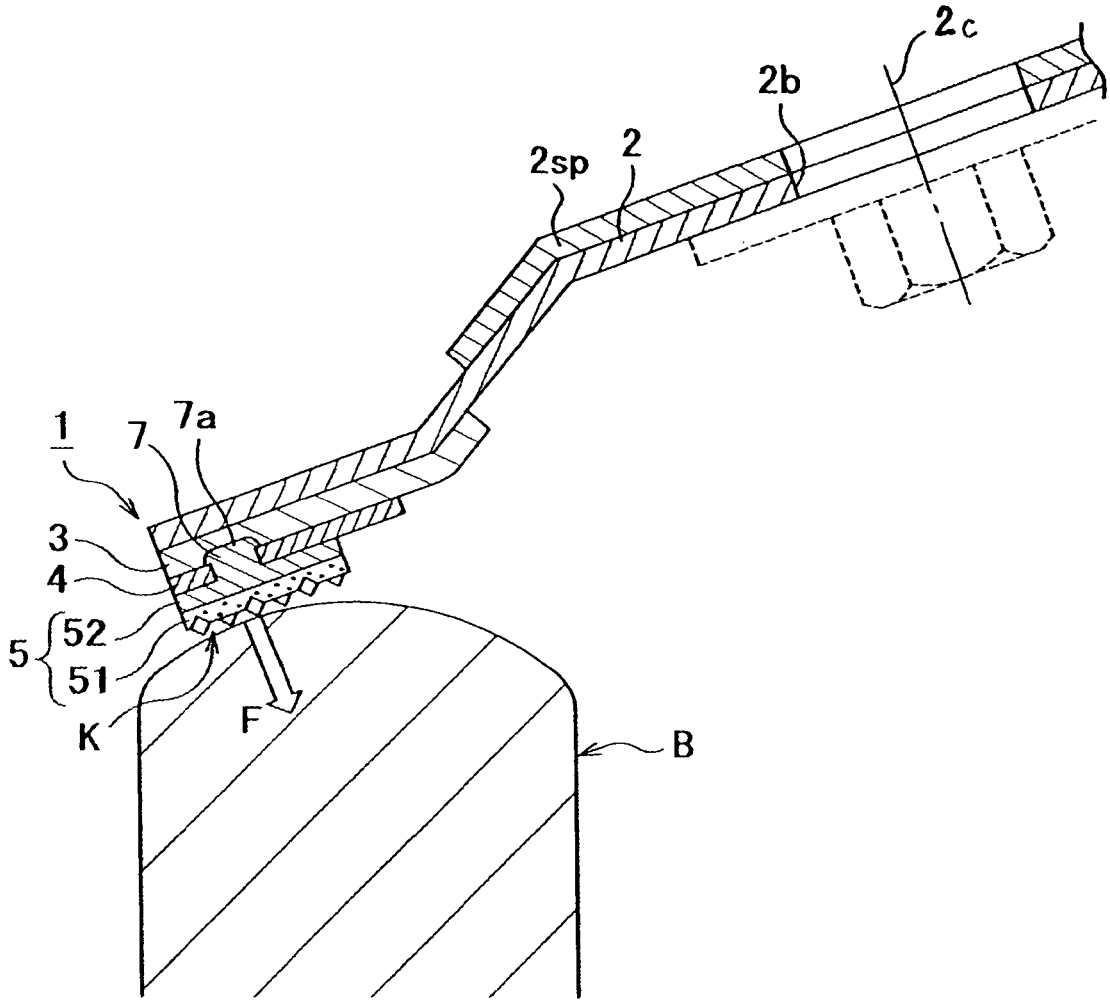
FIG. 6B is a schematic that shows a zoomed-in view of the elemental part of another embodiment of the abrasive disc which is under abrasion operation.

The disc substrate 2 is made of so-called glass epoxy resin that is a mixture of epoxy resin with glass fibers, which turns into a flexible plastic resin and is substantially formed into the disc shape. A center O of the disc substrate 2 is defined by a rotation hole 2*b* to which a rotation shaft 6*a* of the grinder 6 is set. As shown in FIGS. 2, 6A and 6B, the disc substrate 2 is rotatable by the rotation shaft 6*a* of the grinder 6 about a center axis of rotation 2*c* of the disc substrate 2 extending through the center O. As shown in FIG. 2, a substantially planar elastic sheet 3 is fixed onto the planar annular stage 2*a* which is defined by a substantially planar outer peripheral portion of the disc substrate 2 oriented substantially perpendicularly to the center axis 2*c*. The suspension plate 4 is fixed on the elastic sheet 3 on which many abrasive chips that have abrasive layers 51 including abrasive D, such as diamond abrasive, etc., and substantially planar metal pieces 52 are fixed.

The elastic sheet 3, which works as a cushion to absorb the mechanical shock generated in the operation of the abrasive disc, is formed in a shape that has a slightly lesser inner diameter than that of the annular stage 2*a* of the disc substrate 2 and has a substantially same outer diameter as that of the disc substrate 2 as shown in FIG. 3A. The elastic sheet 3 completely covers the annular stage 2*a* and protects it against the damage by the outer force. The elastic sheet 3 is formed with a thin but strongly hard synthetic rubber or synthetic resin and is adhered to the surface of the annular stage 2*a* of the disc substrate 2. The suspension plate 4 is fixed to rather outer peripheral of the elastic sheet 3.

As shown in FIG. 1, the suspension plate 4 is made of the flexible metal that is flexible spring steel or rolling metal. The suspension plate 4 has an enough thickness to be endurable against the staking force applied to the stakes 7, suppresses the deformation against the pressing force of the abrasion work and the centrifugal force due to the rotation of the abrasive disc and keeps the flexibility of cushion characteristics in the abrasion work. The suspension plate 4 is fixed to the elastic sheet 3 under the abrasive chips 5 and has stake holes 4*a* through which the stakes 7 are inserted to firmly fix the abrasive chips 5 (FIG. 3A). The stake holes 4*a* are made for the number necessity for the stakes 7.

As shown in FIG. 3A, the abrasive chip 5 has an abrasive layer 51 and a metal piece 52 which has a shape of a curved and deformed parallelogram to be a part of the disc peripheral portion. The abrasive chip 5 has stakes that fix the metal piece 52 to the suspension plate 4.

As shown in FIG. 1, each of the abrasive chips 5 has a shape that has a forward corner 5*a*, the first slant edge 5*b*, backward portion 5*c*, arcuate corner 5*d*, the second slant edge 5*e* and the third slant edge 5*f*. The abrasive chips 5 are fixed to the surface of the suspension plate 4 which has an annular shape. The abrasive chips 5 are inserted into the stake holes 4*a* made in the suspension plate 4 by using stakes 7. The abrasive chips 5 have gaps t between two adjacent abrasive chips 5. The backward edge of an abrasive chip of the forward position and the forward edge of the abrasive chip which is adjacent to the forward chip in the rotational direction are partly overlapped in the radial projection direction.

Figure 3B:
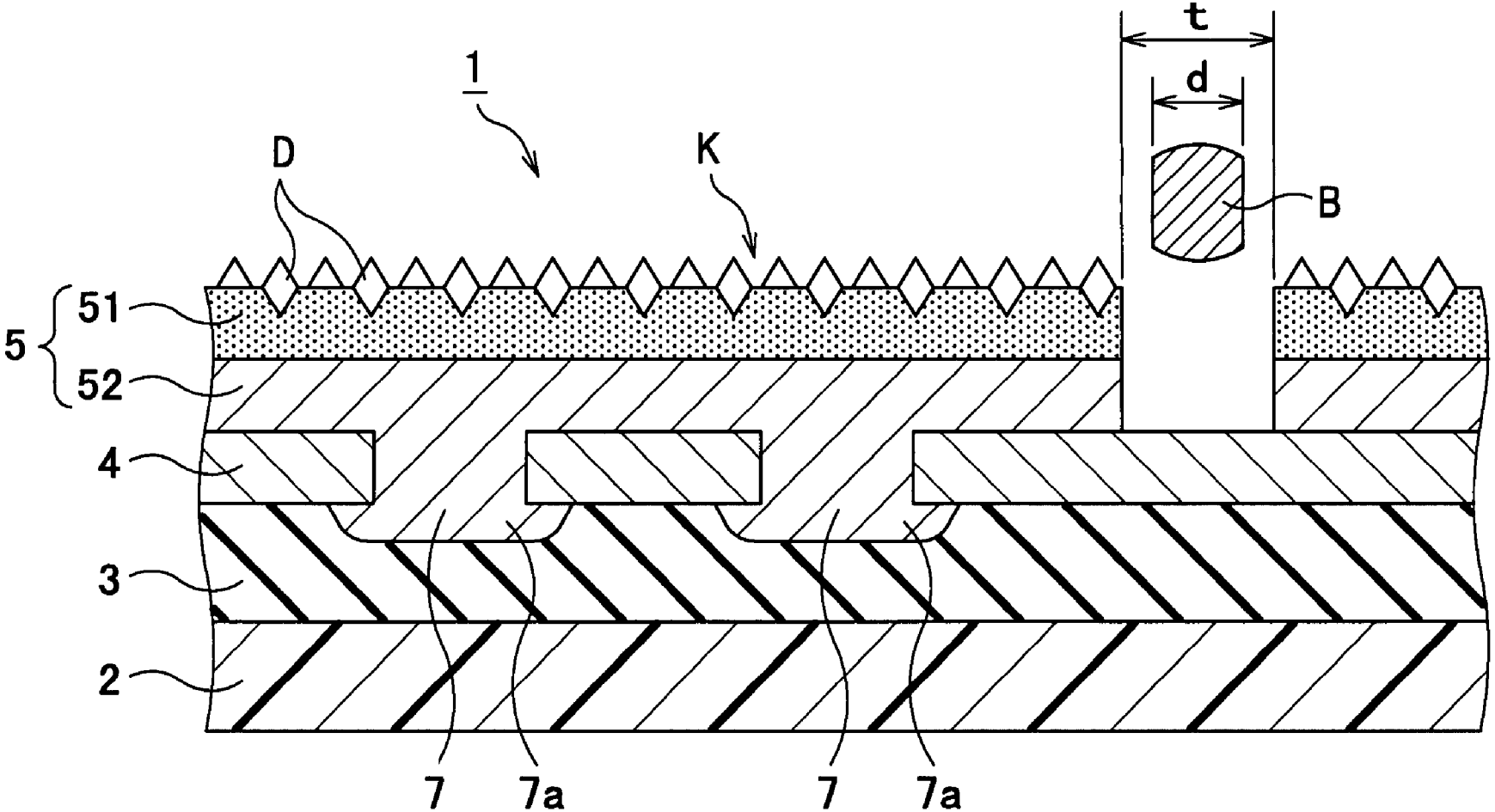
FIG. 3B is a schematic that shows a zoomed-in cross sectional view of the elemental part of the abrasive disc.

FIG. 3B is a schematic that shows a zoomed-in view of the elemental part of the abrasive disc.

As shown in FIG. 3A and FIG. 3B, the abrasive D is made from, for example, diamond, cubic boron nitride (CBN), etc. and adhered to the metal piece 52. The abrasive D may be silicon carbide, alumina or their compounds.

The abrasive layer 51 is a binding compound to fix the abrasive D to the metal piece 52. The abrasive layer 51 comprises an electrical deposition with a binder to bind the abrasive D.

The abrasive layer 51 may be made of resin bond of which major compound is thermosetting resin, metal bond with major compounds such as copper, tin, iron, cobalt, nickel, etc. or vitrified bond with major compounds such as glass and other non-organic materials. For the variety of the object to be abraded, appropriate selection of means to fix the abrasive D to the metal piece 52 is specifically required and is made over the wide range of those materials described before.

The metal piece 52 composes a sill which is made by the cooled reduction roll. Two stakes 7 are formed in each of the single molding of the metal piece 52 thereunder.

The stakes 7 are alternated to be rivets of rod shape or eyelets shape with depending on the application.

Figure 4A:
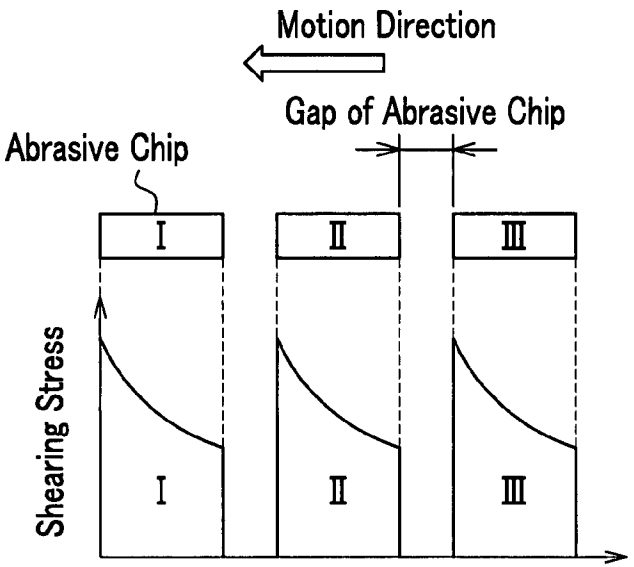
FIG. 4A is a schematic that conceptually shows a shearing stress against the shape of abrasive chips which have the right-angled front edges to the abrasive chip motion direction.

It is important that the abrasive disc has a capability to exhaust out the cuttings quickly after abrading the objects because the cuttings and abraded debris are abraded again by the abrasive disc even they are not necessary to be abraded anymore. Such unnecessary abrasions shorten the life time of the abrasive disc in the service. In order to realize a smooth exhausting of the cuttings, exhausting channels in the abrasive disc are required. The present invention is proposing an arrangement of abrasive chips so that the gaps between two adjacent abrasive chips work as the exhaust channels. However, the shearing stresses applied to the abrasive chips are generated as shown in FIG. 4A if the abrasive chips have the front edges which are right angle to the motion direction which is actually a rotation direction in the disc revolution. The front portion of the abrasive chip receives large shearing stress and the backward portion has less shearing stress. The reason is that the front edge abrades the surface height difference between the level abraded by the forward abrasive chip and the level to be newly abraded by the following abrasive chip. The front edge of the abrasive chip starts the abrasion after abrasion carried out by the previous abrasive. The high peak of the shearing stress applied to the abrasive generates a force to strip-off the abrasive chips from the suspending plate.

Figure 4B:
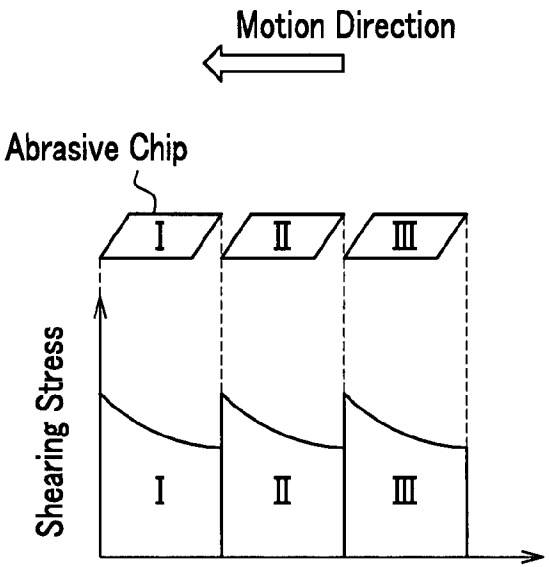
FIG. 4B is a schematic that conceptually shows a shearing stress against the shape of abrasive chips which have slanted front edges.

However, if the front edge is slanted to the motion direction rather than the right angle to the motion direction, the shearing stress can be reduced and becomes not to be so large as that of the front edge with right angle to the motion direction which is shown in FIG. 4B. One of the reasons is that the roughness of the object such as given by the surface height of the object is abraded by a part of the front edge line which gradually increases in the rotation toward the whole front edge line. Therefore the shearing stress can be relaxed at the front edge portion.

Figure 4C:
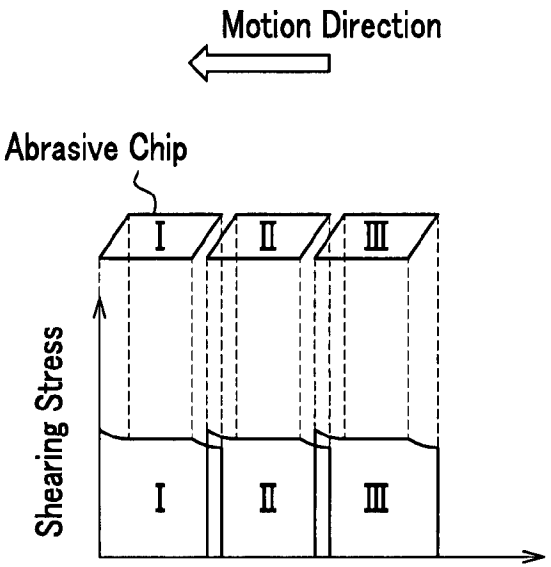
FIG. 4C is a schematic that conceptually shows a shearing stress against the shape of abrasive chips which have slanted front edges which overlap the backward edges in the projection to the right angle to the motion direction.

The abrasive chip configuration as shown in FIG. 4C, the roughness of the object, which is mostly in the line of right angle to the motion direction of the abrasive chip, does not drop into the gaps between two adjacent abrasive chips. Therefore, the shearing stresses against to the abrasive chips are substantially constant as shown in FIG. 4C. This constant shearing stress supports long life time due to less shearing stress force against the abrasive chips. The abrasive chips are discretely arranged on the abrasive disc, however the arrangement of the abrasive chips realize the continuous abrasion operation.

The slanted front edges of the abrasive chips facilitate the exhaustion of the cuttings and abraded debris in the rotation of the abrasive disc because the carrying out force is applied to them while the abrasive disc rotates. The less presence of the cuttings and the abraded debris causes less ware out of the abrasive chips.

Figure 5A:
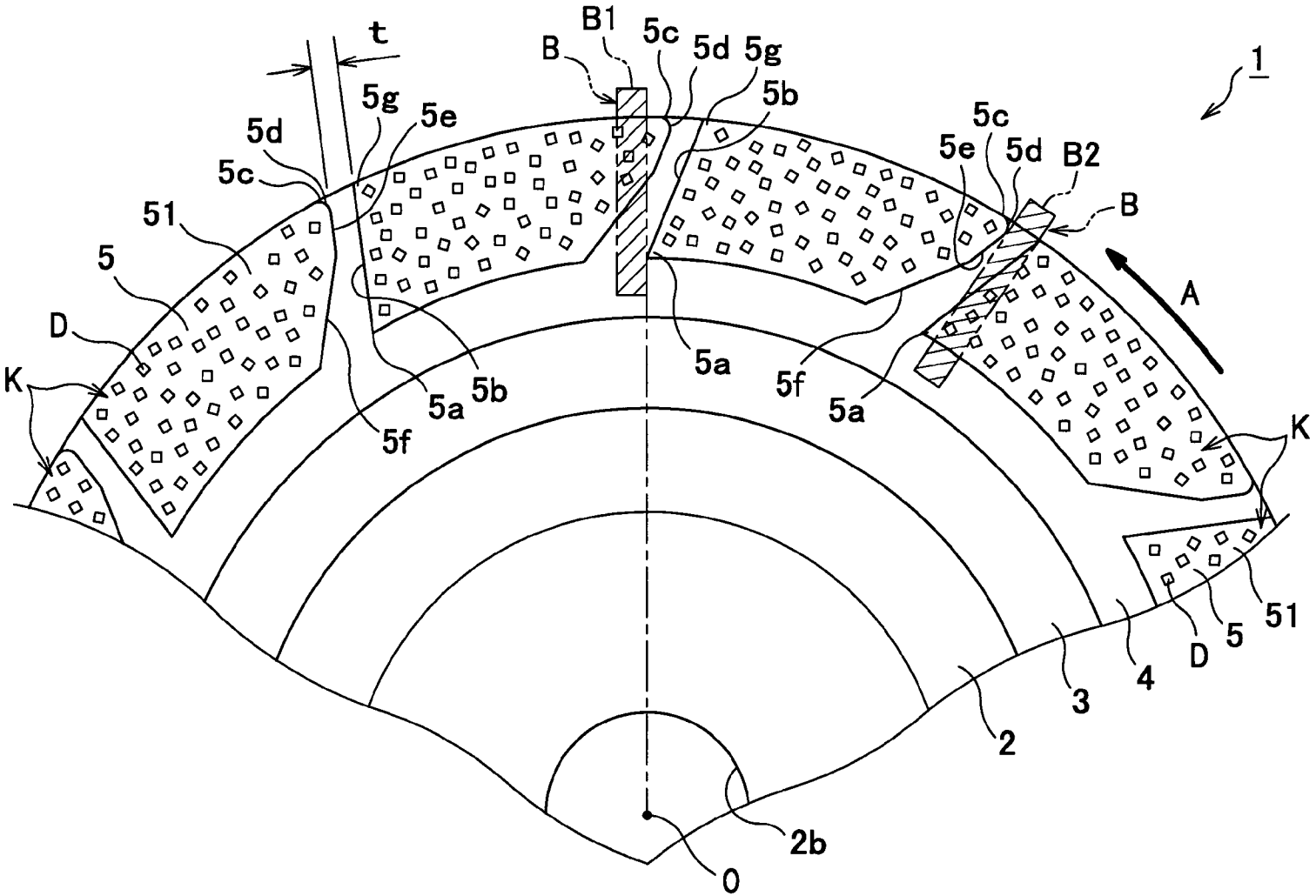
FIG. 5A is a schematic that shows a zoomed-in plan view of the elemental part of an embodiment of the abrasive disc.

FIG. 5A is a schematic that shows the zoomed-in plan view of the elemental part of the abrasive disc. One of the features of the present invention is to have a concept of continuous abrasion arrangement of the abrasive chips. When the abrasive disc has plural abrasive chips around the disc, it is important that the front edges of the chips do not directly hit the objects, which generate shearing stress against the abrasive chips. The shearing stress easily takes the abrasive chips off from the disc substrate or the hitting of the front edges of the abrasive chips implies short life time of the abrasive disc. The design rule for the continuous abrasion arrangement is that the radial line from the center of the disc is always on the patterns of the abrasive chips. In other words, the line locates never in the gap regions between two adjacent chips. The detail design is discussed in the next.

As shown in FIG. 5A, the forward edge 5*b* is the forward arm of the abrasive chip 5 when the abrasive disc 1 is rotated in the rotational direction (A direction). The forward portion is defined as the inner peripheral circle of the suspension plate 4. From the forward edge 5*b* is slanted in outward and has a forward corner 5*a* at the inner end of the forward edge 5*b*. The outer forward corner 5*g* is the end of the outer end of the forward edge and has a round shape with about 1 mm radius. This round shape of the outer forward corner 5*g* is to divert the shock against the objective material B when the abrasive chip 5 hits the objective material B. The backward edges of the abrasive chip 5 consist of a round corner 5*d* and backward edges 5*g* and 5*f*.

The backward arm of the abrasive chip consists of a backward portion 5*c*, an arcuate edge 5*d*, the second slant edge 5*e* and the third slant edge 5*f*. The arcuate edge 5*d* has an arc shape against the outer direction and has a finite radius by which the outer force is diverted from the cross point between the peripheral arm of the abrasive chip 5 and the second slant edge 5*e* so that the drop off of the abrasive chip 5 is suppressed or prevented.

The second slant edge 5*e* extends from the arcuate edge 5*d* against to the center of the abrasive disc 1 with a declination to the forward corner 5*a* of the abrasive edge 5. The second slant edge 5*e* is formed to be substantially parallel to the first slant edge 5*b*.

The third slant edge 5*f* extends from the second slant edge 5*e* and is formed in a shape that the gap with the adjacent abrasive chip is widened toward the center of the abrasive disc 1. The third slant edge 5*f* has further declination towards the forward corner 5*a* in comparison to the second slant edge 5*e*.

The backward portion 5*c* is placed in the backward direction in the rotation (direction A) from the forward edge 5. This alignment is determined in a manner that an object is kept to contact with the backward portion of the abrasive chip 5 including the backward portion 5*c* when the object is contacted with the forward corner 5*a* of the subsequent abrasive chip 5. The second slant edge 5*e* and the third edge 5*f* are the extension from the backward portion 5*c*. These two slant edges can be simplified to be a single slant edge.

Figure 5B:
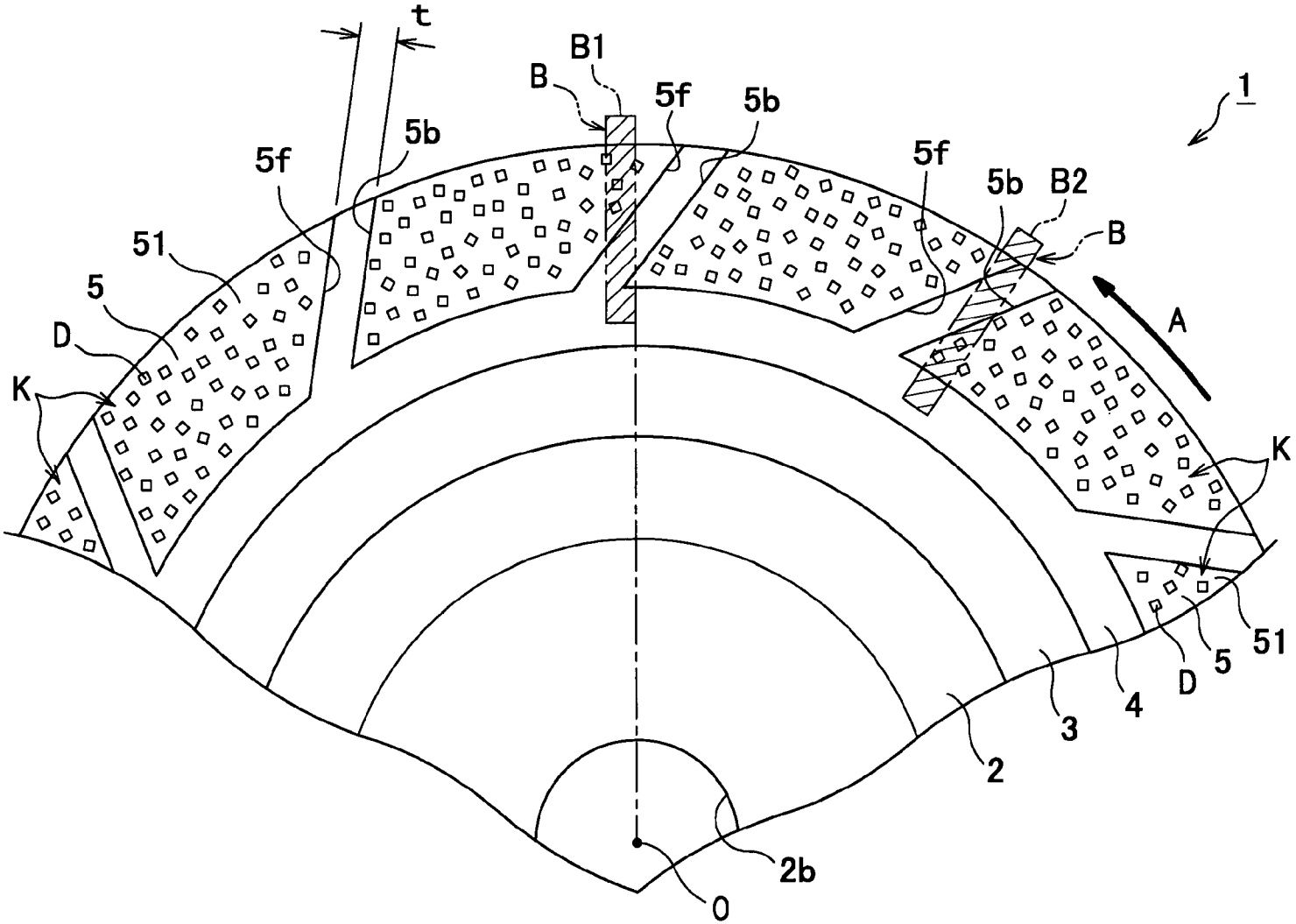
FIG. 5B is a schematic that shows a zoomed-in plan view of the elemental part of another embodiment of the abrasive disc.
Figure 5C:
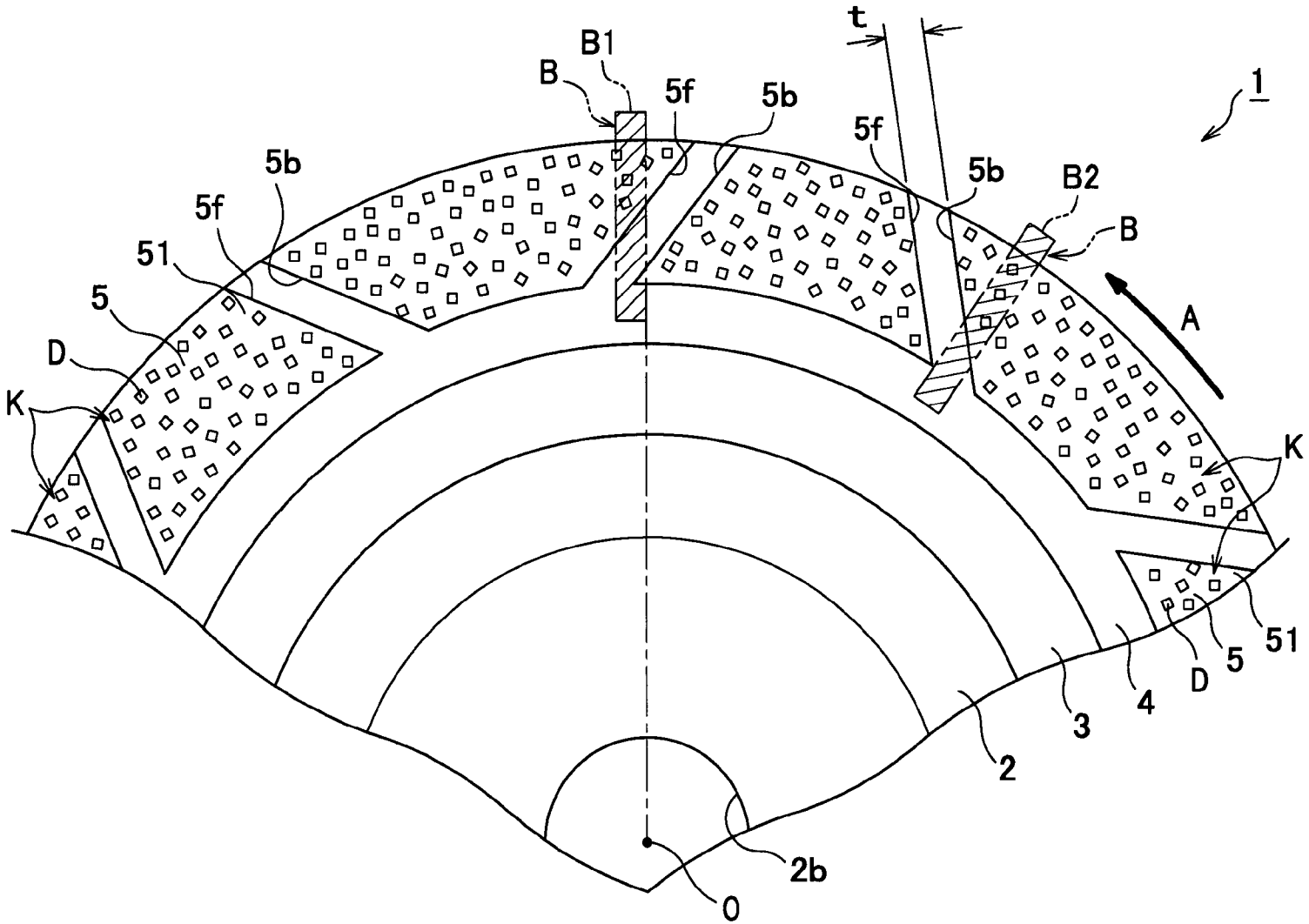
FIG. 5C is a schematic that shows a zoomed-in plan view of the elemental part of another embodiment of the abrasive disc.
Figure 5D:
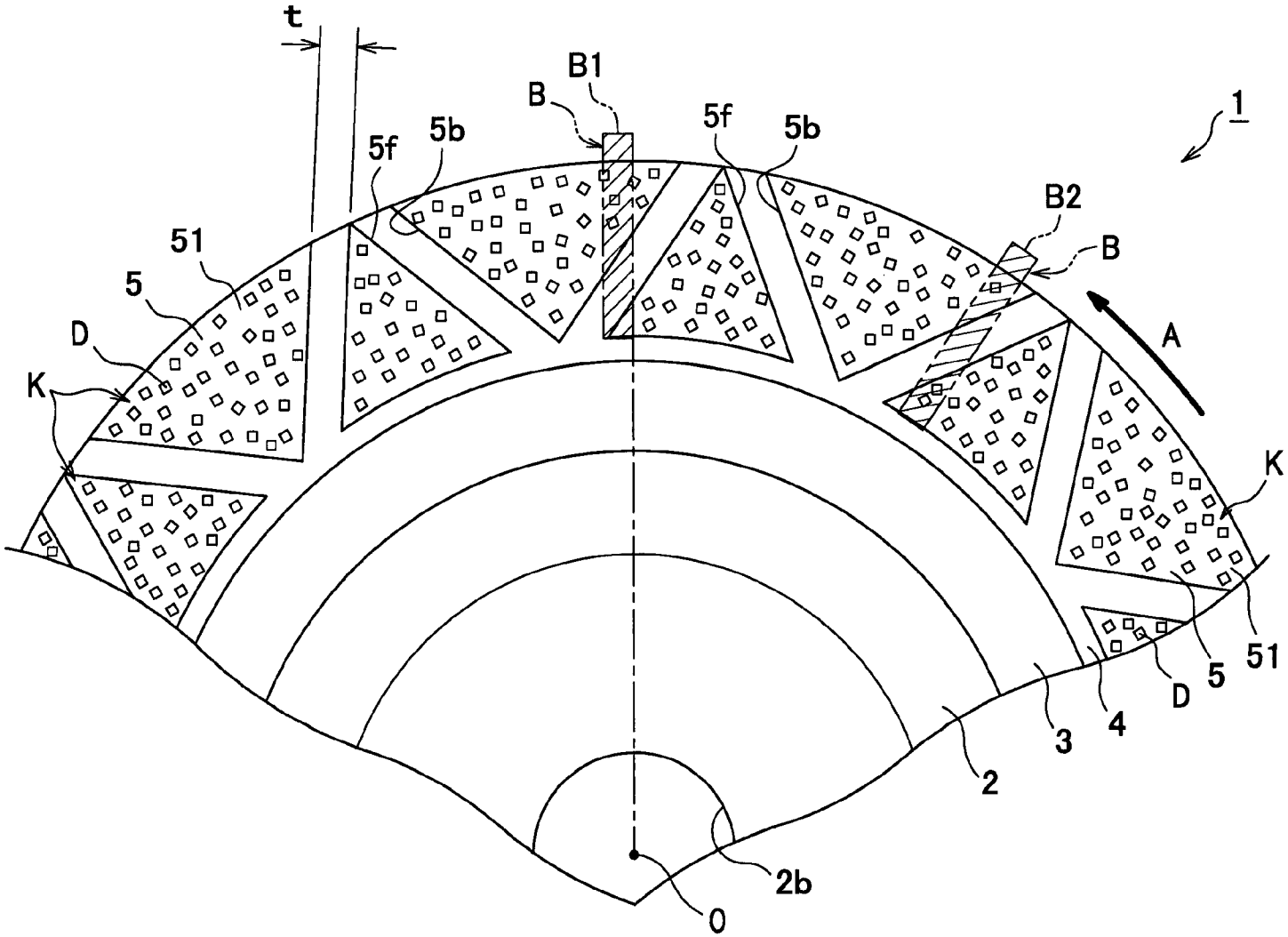
FIG. 5D is a schematic that shows a zoomed-in plan view of the elemental part of another embodiment of the abrasive disc.

FIG. 5B to 5D show other embodiments of the abrasive chips 5. They are more simplified edges than those shown in FIG. 5A. The forward edge 5*b* and the backward edge 5*f* are all straight lines for the abrasive chips shown in FIG. 5B to 5D. The forms of the abrasive chips shown in FIG. 5B, 5C and 5D are substantially a rectangular shape, a trapezoid shape and a triangle shape, respectively.

According to FIG. 3A and FIG. 3B, a melting contact method of the abrasive chip 5 will be explained.

The abrasive chip 5 is preferred such that the abrasive D is coated by the following melting contact. There are two types of the methods: self-melting alloy type and bronze type. The self-melting alloy type uses nickel-chrome alloy powder and the bronze type uses bronze power with titanium powder. These powders are mixed with vacuum binder and made into so-called abradant paste which is put in a pasted abradant layer 51.

The metal pieces 52 which are formed into substantially same forms as the abrasive chips 5 have two stakes 7 on the back surfaces of the metal pieces 52. The stakes 7 are inserted into the stake holes 4*a* made in the suspension plate 4 and the tips of the stakes are deformed for staking and the metal piece 52 is fixed to the suspension plate 4. According to this staking technology, the metal piece 52 is not stripped off from the suspension plate 4 even when the abrasive disc 1 rotates in high-speed. The heads of the stakes 7 are deformed into mushroom shapes as shown in FIG. 3B. The suspension plate 4 is made of a metal such as spring steel. The steaks 7 are deformed for staking and the suspension plate 4 is not deformed. Since the abrasive chips 5 can maintain rigidity due to the firm fixating to the suspension plate 4 and keep a flexibility due to the elasticity of the suspension plate 4 and the elastic sheet 4. A rubber adhesive agent can be used between the abrasive chips and the suspension plate.

The process to make the abrasive chips 5 is explained. In order to keep constant thickness of the abrasive chips 5 over all of the abrasive chips 5, a sweeping tool with a still tank to control the abrasive layer 51 put in the tank by sweeping the excess of bonder compound away.

The metal pieces 52 on which the abrasive D is diverted over abradant paste is put in an oven. The binder compound included in the abradant paste is sufficiently evaporated in 24 hours. Then the metal pieces 52 are sintered in a vacuum chamber which provides $10^{-2}$ hecto-Pascal or less with the temperature 1000-1100 deg C. for self-melting alloy type and 800-950 deg C. for bronze type. Under these sinter conditions, the abrasive D is fixed in the nickel-chrome alloy or activated metal bronze.

The abrasive D can be diamond abrasive in the above sinter and melting method to fix the diamond abrasive. That is to sinter the diamond abrasive deposited on the metal piece with other melting metals that have wettability to fix the diamond abrasive. The metals can be included in abradant paste which is sintered with the diamond abrasive. As the other method, the diamond abrasive can be fixed onto the metal piece 52 by using Ni plating. The plating can be done in a chemical solution or by electro-chemical method.

There is further another fabrication method for diamond abrasive chips, which are called metal bond abrasive chips. This process allows thick diamond abrasive layers formed on the metal pieces. The diamond fixing in the binding metals is carried out by the solid phase solidification with liquid-solid alloy process with cupper and tin. The solid phase sintering of cupper, bronze, nickel and cobalt is simultaneously carried out and these metals turn into a mixed crystal. The sinter process condition is 5 Tons/cm2 at 900 deg C. in the ambience of a reduction gas such as hydrogen gas with a nitrogen gas as a buffer gas.

As for the bonding metal for the metal bond abrasive chips, a single cobalt metal is used in another fabrication method. The pressure and temperature conditions are same as the above, however cobalt, a single binding metal, is only used. The self-shrinking of cobalt fixes the diamond abrasives.

In order to harden the bonding metal tungsten, silver, steel or their combination is further used. As the result of the hardening of the bonding metals, the cuttings or debris generated in the abrasion operation hardly stick on to the surface of the abrasive chip so that the abrasion speed does not decrease in the abrasion operation. Therefore, the metal bond abrasive chip can last long in services.

The abrasive D bound in these metals can be strongly bonded with the activated metal by forming a reactive layer to make a metal binding layer so that the abrasive D can be projected from the surface of abrasive chips 5 more than the abrasive chips which use non-activated bonding metal. The abrasive chips 5 can be taken from the vacuum chamber after cooling down.

There is another bonding method of the abrasive D with the metals such as electro-chemical deposition. The former is to deposit nickel onto the diamond abrasive as well as the metal piece. The other deposition is an electrolytic deposition that is performed with plasma which contains the binding metal in an ion. The metal ion is deposited on the diamond and as well as the metal piece.

The elastic sheet 3 is adhered to the annular stage 2*a* of the disc substrate 2 with a synthetic rubber adhesive agent. The annular stage 2*a* and the elastic sheet 3 have the same annular form so that a homogenous contact over the extensive plane is obtained and firm adhesion is possible.

On the elastic sheet 3, the suspension plate 4 on which the abrasive chips 5 are fixed is adhered with a rubber adhesive agent. Further, the disc substrate 2, the elastic sheet 3, suspension plate 4 and the abrasive chips 5 are all together pressed in high temperature. The elastic sheet 3 and the suspension plate 4 have the same annular shapes and the extensive area so that firm fixing is possible. The abrasive disc is finally completed.

As explained above, it is possible that the flexibility between the disc substrate 2 and the suspension plate 4 cannot be interfered by the elastic sheet 3 due to the elasticity of the elastic sheet 3 therebetween.

As shown in FIG. 3B, the heads 7*a* of stakes 7 which are projected from the suspension plate 4 are buried in the elastic sheet 3. The elastic sheet 3 has cushion properties so that the heads 7*a* of the stakes 7 do not contact to the disc substrate 2 and the elastic sheet can contact with the disc substrate 2. The suspension plate 4 can be firmly fixed to the disc substrate 2 and sufficient adhesion is obtained. The elastic sheet 3 can be against the centrifugal force when the abrasive disc 1 rotates in high-speed, the absorbs mechanical shock of the abrasive chips 5 against the object B is and suppresses the strip-off of the abrasive chips 5. As has been explained, the elastic sheet 3 can indirectly suppress the strip-off of the abrasive chips 5.

Furthermore, since the abrasive disc 1 has the elastic sheet 3, therefore the abrasive disc 1 has a capability not to propagate but to absorb the vibration and acoustic noise generated in the abrasion operation.

The abrasive disc 1 has a suspension plate 4 on the side of elastic sheet 3 against the disc substrate 2. When the abrasive chips 5 are deformed due to the thermal heat by the abrasion and mechanical hits to the object, the disc substrate 2 and the elastic sheet 3 do not suffer the damages.

The functions of the elements comprising the present abrasive disc 1 are explained in details.

As shown in FIG. 2, the abrasive disc 1 is attached to a rotation tool such as a grinder 6 for the abrasion of the object B (as shown in FIG. 6) and the abrasive chips 5 contact with the object B when the abrasive disc is rotating. The abrasive disc is assembled on flexible, bendable and strengthened disc substrate 2. The applied force is given through elasticity of the disc substrate 2, the suspension plate 4 and the elastic sheet 3 from the rotation tool. Due to the elasticity of the abrasive disc 1, the generation of the vibration and acoustic noises is suppressed. Since the disc substrate is made of plastic, the lightness of the weight contributes to lessening the weight of the total abrasion tool.

The suspension plate 4 has the rigidity and the flexibility since it is made of the spring steel. The suspension plate 4 can cut off the mechanical shock or the thermal shock generated by the abrasion so that the object do not directly touch with the elastic sheet 3 and disc substrate 2 and protect them.

As shown in FIG. 1, there is separation gap t for each of adjacent abrasive chips 5. Each abrasive chip 5 smoothly abrades the object surface and small curved surfaces are covered by the abrasive chips 5 and are smoothly finished.

As shown in FG. 5A, when the abrasive disc 1 abrades an object of the small piece as denoted as B1, of which surface to be abraded is K. FIG. 5A shows the outer peripheral of the abrasive chip 5 contacts the small piece B1 when the inner peripheral contacts the surface of the object.

Therefore the small piece B1 does not dropped in the gap t and the abrasive chips 5 are not necessary to vertically move to avoid the objects to sink in the interval gaps.

When the object locates in B1, the object does not sink into the gap interval t. Therefore the object does not hit to the inner forward corner 5*a* and the acoustic noise generation is suppressed. The abrasive chips 5 are hardly striped-off.

As shown in FIG. 3B, the object B of which width is d does not sink into the interval gaps t of two adjacent abrasive chips 5. Therefore, the suspension plate 4, the elastic sheet 3 and the disc substrate 2 are easily curved by widening the interval gaps of the abrasive chips 5 and it is possible to increase the flexibility of the abrasive disc 1.

FIG. 6A is a schematic that shows the zoomed-in view of the elemental part of the abrasive disc which is under abrasion operation. When the abrasive disc 1 abrades the object B, a weight G due to the gravity is applied to the object B. The disc substrate 2 makes the pressure force F and bends backwardly in the direction C.

As shown in the chained lines, the abrasive disc bends backwardly by the counter force C. The shearing stress S against the abrasion and rotational torque T is generated. The abrasive chip 5 tends to be laterally dismounted from the disc substrate 2 by a shearing stress S. This shearing stress S is a drag against the abrasion and rotation torque T. The shearing stress S is transmitted through the stake 7 and absorbed by the elasticity of the suspension plate 4. Therefore, the abrasive chips 6 are not diverted from the abrasive disc 1.

The abrasive disc 1 regarding the present invention is not confined in the embodiment as described above but can be embodied in various modifications and variations under the scope of the present invention. FIG. 6B shows another embodiment which has a supplemental plate 2*sp* on the central portion on the surface of the disc substrate 2 in a concentric shape contacting to the disc substrate 2. Due to the presence of this supplemental plate 2*sp*, the disc substrate hardly bends against the object B even the abrasive disc is strongly pushed against the object B. Therefore the abrasion operation can be shortly done.

According to this supplemental plate 2*sp*, the disc substrate has more toughness therefore the abrasive disc can be applied to the highly tuberous surface abrasion and the hard surface abrasion.

Figure 7A:
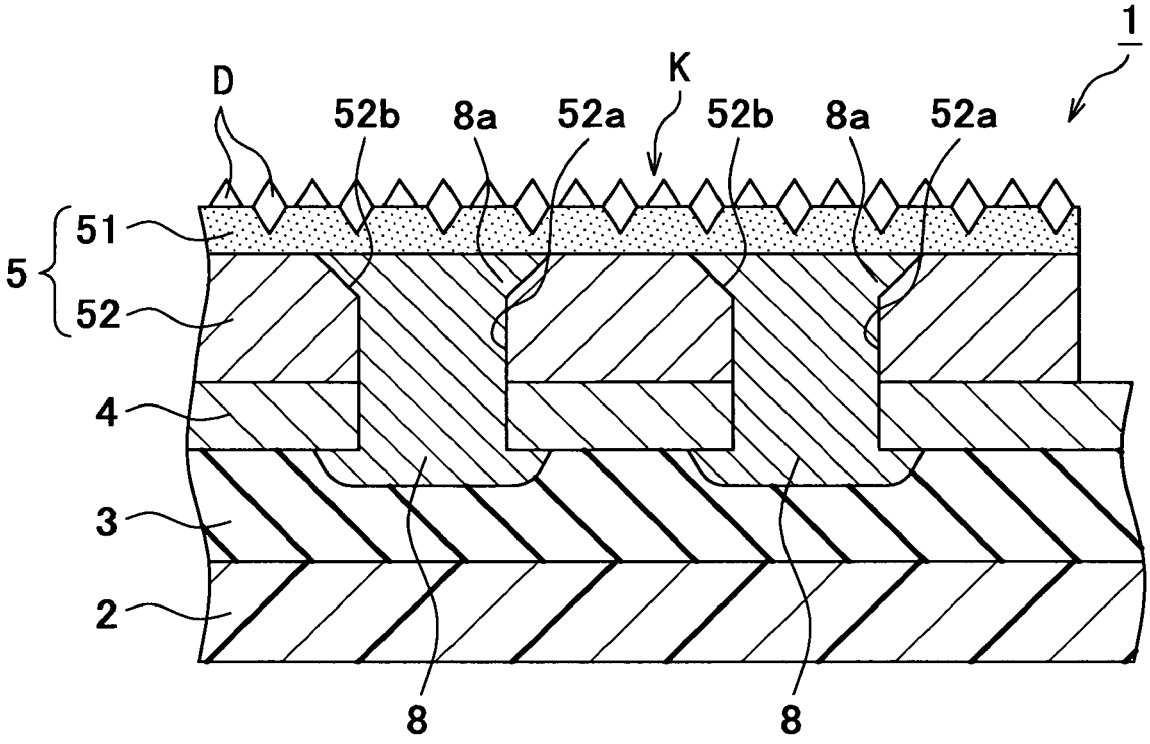
FIG. 7A is a schematic that shows an example of the deformation of the stakes in a zoomed-in view of an embodiment of the elemental part of the abrasive disc.
Figure 7B:
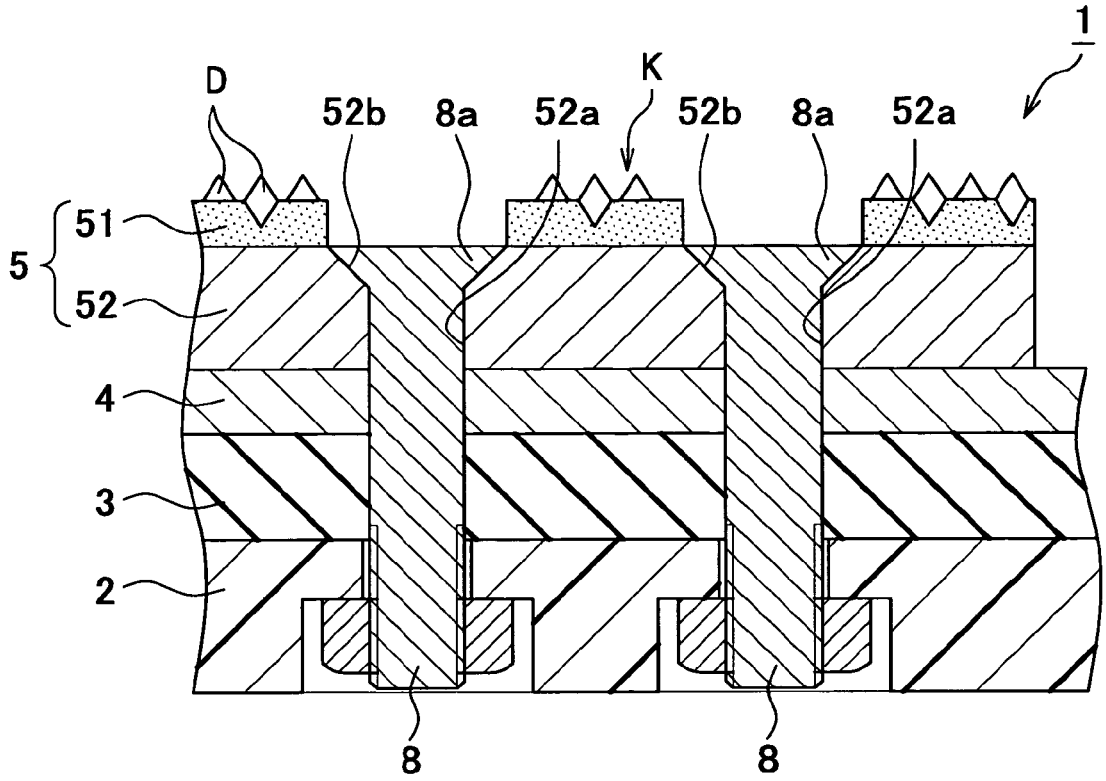
FIG. 7B is a schematic that shows another example of the stakes in a zoomed-in view of the elemental part of the abrasive disc.
Figure 7C:
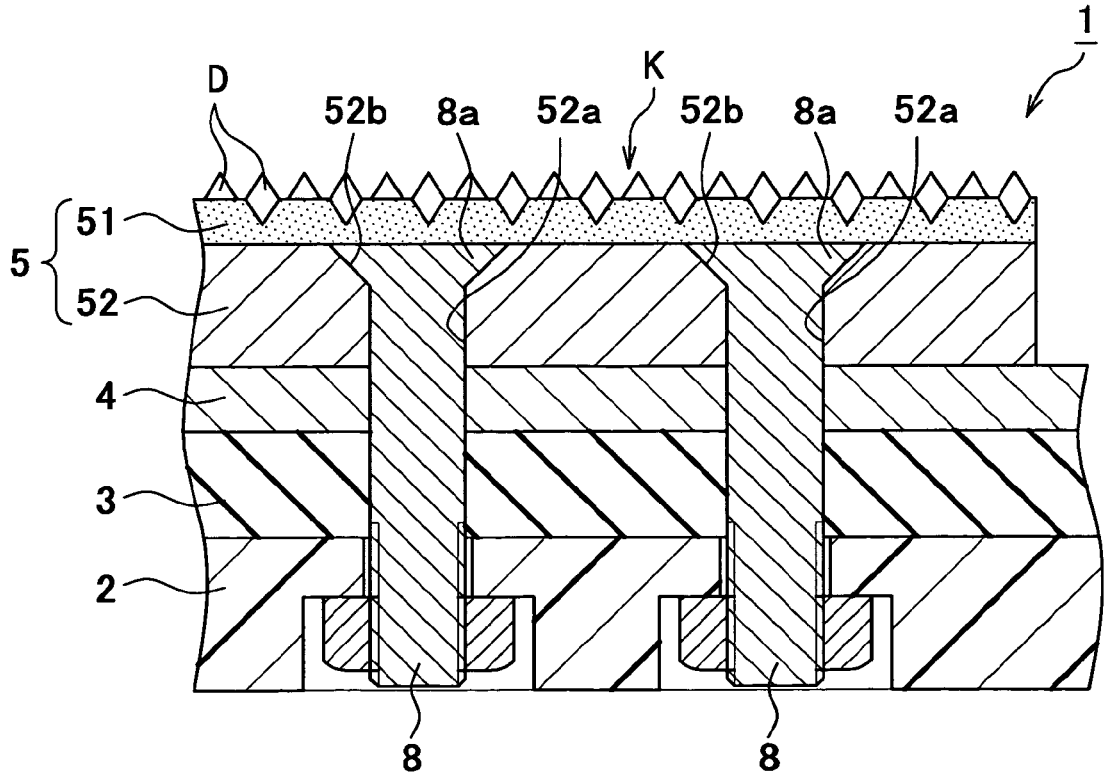
FIG. 7C is a schematic that shows another example of the stakes in a zoomed-in view of the elemental part of the abrasive disc.

Stakes holes are made in the metal pieces 52 as well as stake holes 52*a* made in the suspension plate 4 and the stakes are deformed together with the metal pieces 52 and the suspension plates 4. The upper openings of the stake holes 52*a* have chamfer. As shown in FIG. 7A, countersunk rivets are used for the stakes 8 so that the head of the rivets do not protrude from the surface of the metal piece 52 and pressed at the stake portions to tightly bind the metal piece and the suspension plate 4. Other fastening methods of the metal piece 52 are provided by a bolt-nut combination as shown in FIG. 7B and 7C. FIG. 7B shows a pair of bolts and nuts fasten an abrasive chip to the disc substrate 2. The surface of the abrasive chips has openings through which the bolts are inserted. In order to have more abrasive surface, it is preferred that the bolts are fasten to the metal piece and soldered using brazing alloy as well as soldering the abrasive diamond as shown in FIG. 7C.

Figure 8A:
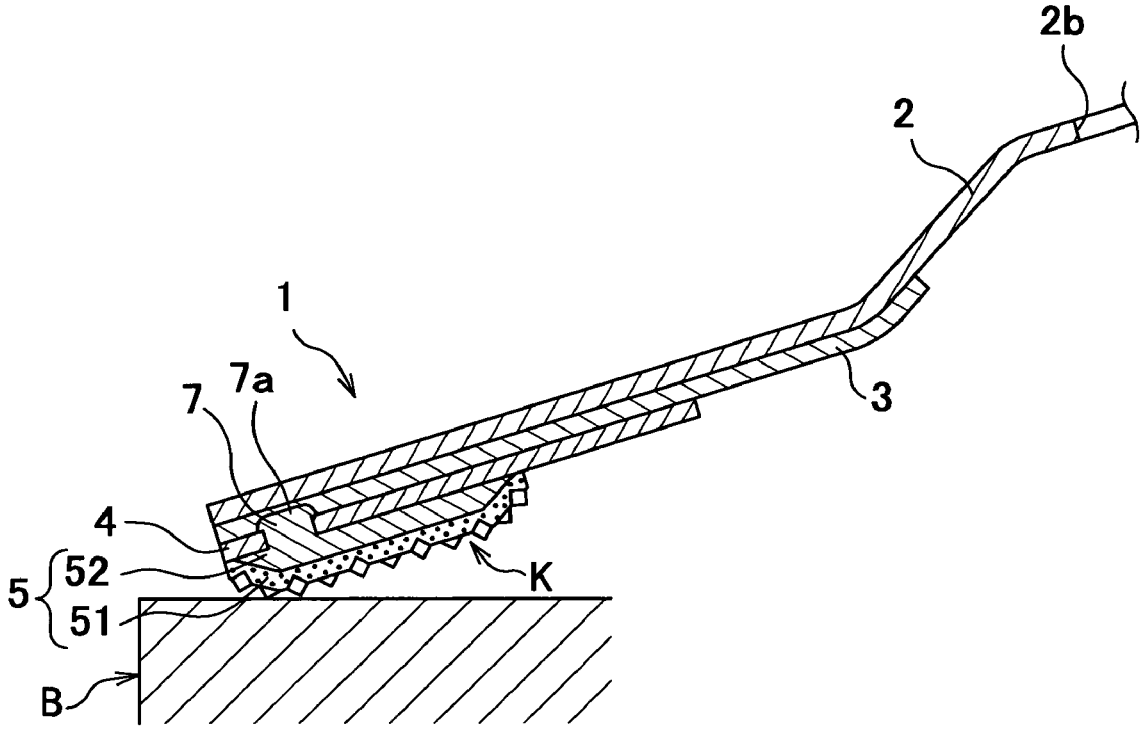
FIG. 8A is a schematic that shows a cross sectional view of the elemental part of an embodiment of the abrasive chips.
Figure 8B:
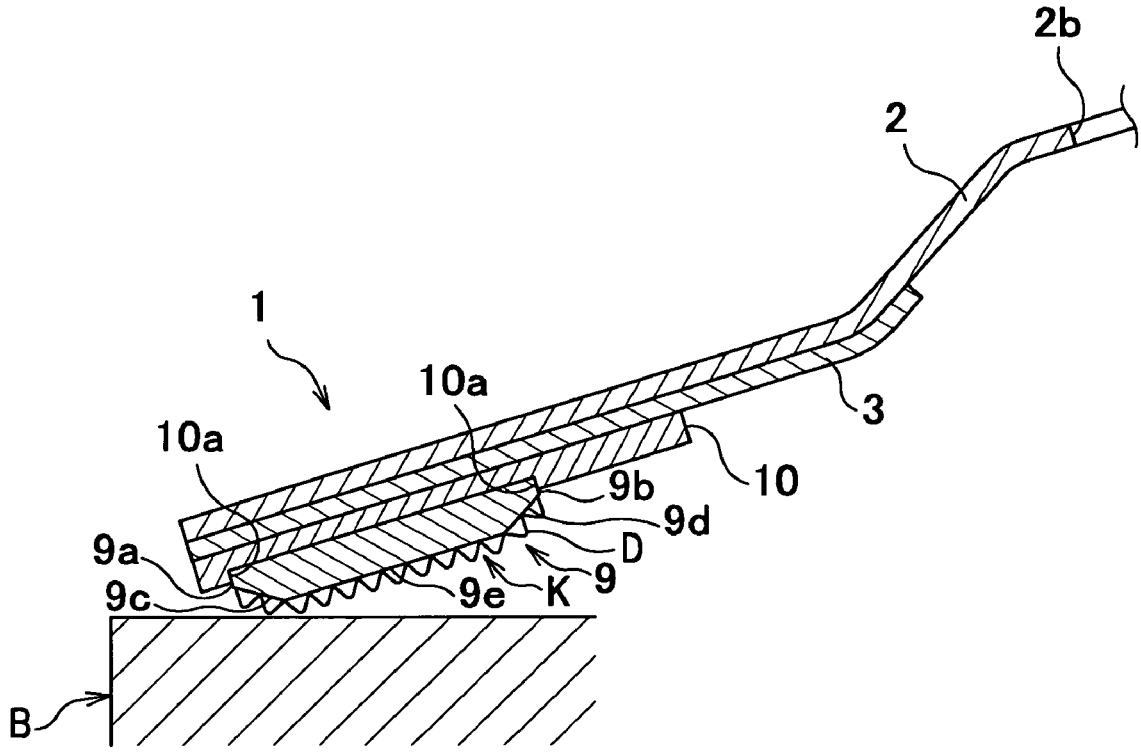
FIG. 8B is a schematic that shows a cross sectional view of the elemental part of another embodiment of the abrasive chips.
Figure 8C:
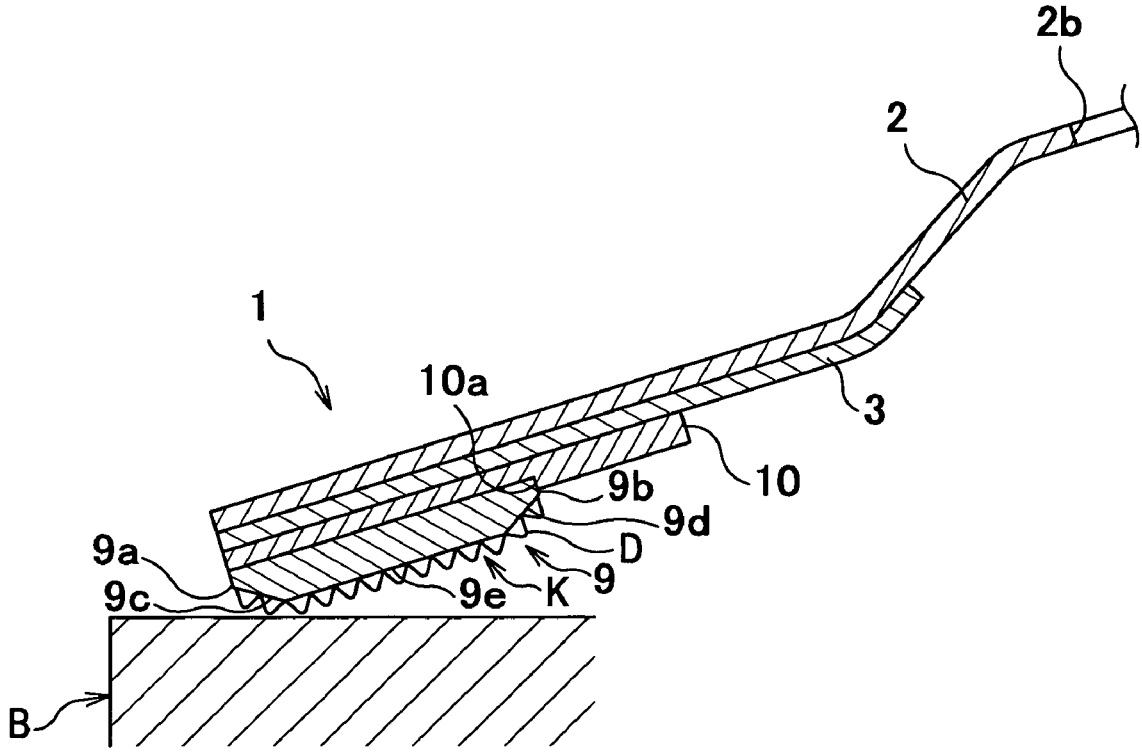
FIG. 8C is a schematic that shows a cross sectional view of the elemental part of another embodiment of the abrasive chips.

FIG. 8A shows a zoomed-in view of the abrasive chip K mounted to the abrasive disc. The abrasive layer 51 and the metal pieces 52 have sloped surfaces at the peripherals therefore the sloped surfaces contribute to the abrasion. The lack of the edge portion of the abrasive chip 5 generates less shearing stress in the rotation of the abrasive chip 5. In order to realize another toughness against the shearing stress, the suspension plate 10 has a groove 10*a* to keep the abrasive chip 5 therein, as shown in FIG. 8B. There are no stakes in the assembly, however the abrasive chips 5 are hardly stripped off due to the adhesive between the groove surface and the abrasive chip K which has the outer edge 9*a*, the inner edge 9*b*, the outer slope surface 9*c*, the inner slope surface 9*d* and the top surface 9*e*. FIG. 8C shows another embodiment of the present invention which has a construction that the surrounding of the groove 10*a* has no abrasion capability therefore the edge of the abrasive disc does not abrade the object B. The mounting of the abrasive K as shown in FIG. 8C has no outer surrounding of the suspension plate 10 so that the abrasive D can directly touch the object B at the slope surface 9*c* of the abrasive K.

According to the suspension plate 10 which has an opening groove edge as shown in FIG. 8C, the shearing stress is not applied to the opening edge since the rotational torque is right angle to the opening edge direction so that the abrasive chip K is hardly stripped off from the suspension plate 10.

In all above embodiments, the twelve abrasive chips to be attached to the disc substrate are used. However the implementation of ten abrasive chips is further preferred. The features of such implementation is that effective area of the abrasive chips against the objects decreases so that the pressure force loaded to the abrasive layer increases per area and the abrasive more deeply sink into the object which results into high-speed abrasion. The gap between two adjacent abrasive chips becomes larger so that quicker evacuation of abraded particles is possible which results in less clogging of cuttings and debris in the abrasive layer.

The abrasion speed and the life time of the abrasive disc depend on the quantity of abrasive chips or the abrasive area which is defined by the occupation area of the abrasive chips against the area of the annular which is defined by the trajectory of the abrasive chips in the disc rotation. Table 1 shows the experimental results of several variations of the abrasive chips regarding quantities and occupation areas. The objective was hard urethane painted on a concrete floor. The life of the abrasion disc is determined by the accumulated abraded area at a half value of the abrasion speed against the initial abrasion speed.

TABLE 1

Test results of several abrasive discs which have different abrasive chips.

| Sample No. | Quantity of Abrasive Chips (pcs) | Area of Abrasive Chip (%) | Abrasion Speed ($m^2$/min.) | Life of Abrasive disc ($m^2$) |
|---|---|---|---|---|
| 1 | 12 | 87.6 | 0.58 | 40 |
| 2 | 10 | 73.0 | 0.90 | 60 |
| 3 | 9 | 65.7 | 1.10 | 45 |
| 4 | 8 | 58.4 | 0.98 | 40 |
| 5 | 6 | 43.8 | — | — |

In this test, the diamond abrasive #40/50 was used. The quantity of abrasive was 30 particles per chip.

For the abrasive chip of sample No. 5, the gaps between two adjacent abrasive chips are large enough and the objects "dropped" in the gaps in the abrasion operation. The abrasive disc jumped and no normal abrasion was carried out in the abrasion operation. The abrasion performance against the quantity of the abrasive chips is evaluated determined by the loading weight per abrasive particle, the quantity of abrasive particles exposing to the object and exhaust speed of cuttings through the gaps between two adjacent abrasive chips. Due to this experiment, it is concluded that the quantity of the abrasive chips should be in the range of eight to twelve and the occupation areas of the chips be 90-50% of the annular area.

In order to fabricate thick diamond abrasive chips, one of solid phase processes has been used to fabricate the diamond abrasive chips called metal bond abrasive chips as described before. A metal bond abrasive chip is fabricated by sintering the metal piece 52 on which a rather thick layer of the mixture of binding metal powder and diamond abrasive grains is pasted. The diamond grains are fixed in the activated metal layer after sintering. The fixing is merely by the volumetric shrinking down of the binding metal due to cooling. Due to the finite and homogeneous size of the diamond grains, the diamond grains make layers depending on the thickness of the abrasive layer during sintering. For the metal bond abrasive chips we tested, the diamond abrasive was #30/40 (590/420 micro meters) and the diamond concentration was 15 weight %. Four layers were made in 2 mm abrasive layer.

Another fabrication method to make diamond abrasive chip is carried out by sintering with titanium (Ti) and chrome (Cr) metals in a vacuum environment. The method is called activated metal bonding and the diamond abrasive chip fabricated by this process is called activated metal bond abrasive chip. These metals have wettability for the diamond surfaces and have chemically activated binding force with diamond, which is the source of wettability. The chemical activation binding is classified into ionic bond, covalent bond, metallic bond and hydrogen bond. The activated metal bonding is metallic bond such that the diamond is metalized with titanium into titanium carbide. Since the diamonds are fixed by the wettability, the fixing of diamond grains is stronger than the fixing by metal thermal shrinking. Therefore it is possible to keep high exposing volume such as 30-40% for the diamond grains. For this purpose, a rather thinner activated metal layer is adopted as especially a single layer is used. Due to large exposing volume of the diamond grains, the abrasion speed is larger than that of the metal bond abrasive chips.

The metal bond abrasive chip has multiple diamond layers, therefore diamond layers autogenously come out one after another during wearing out of the diamond grains and the binding metal by the cuttings. Therefore, the life of the metal bond abrasive chips is larger than the activated metal chips which have single diamond layers.

The complex use of different kinds of abrasive chips was tested. Table 2 shows the results of the testing. The combination of different kinds of abrasive chips is shown in a quantitative parameter that is the combination rate as (activated metal bond abrasive chips)/(metal bond abrasive chips). The diamond abrasive size was #35/45. The object was a bathroom wall which consisted of concrete wall including cement, sands and aggregates as the base structure, a primer for adhesiveness with the secondary layer, a mortar layer and acrylic paint. The abrasion was carried out up to the mortar layer.

TABLE 2

Test result of combination of different abrasive chips (the combination of then¥ hips is defined by (activated metal bond abrasive chips)/(metal bond abrasive chips))

| Sample No. | Combination of Chips | Area of Abrasive Metal Bond Abrasive Chip (%) | Abrasion Speed ($m^2$/min.) | Life of Abrasive Disc ($m^2$) |
|---|---|---|---|---|
| A | 12/0 | 0 | 0.033 | 25 |
| B | 10/2 | 14.6 | 0.028 | 37 |
| C | 8/4 | 29.2 | 0.022 | 55 |
| D | 6/6 | 43.8 | 0.015 | 84 |
| E | 4/8 | 58.4 | 0.010 | 128 |

According to the result, it is concluded that the abrasive discs which have combination of activated metal bond abrasive chips and metal bond abrasive chips have roughly twice longer life than those which have single kind of activated metal chips. The large abrasion speed as much as 0.033 to 0.016 $m^2$/min. is required for less fatigue of operator and the long life for the abrasion as much as 40 to 80 $m^2$ is necessary for the merit aspect. From this requirement, the quantity of metal bond abrasion chips as two to six is desirable. In other words, the area of abrasive metal bond abrasive chip as 15-45% is preferable for the abrasive disc configuration.

As has been explaining in details, the elasticity of the elastic sheet 3 keeps the balance between the pressing force of the abrasive disc and the counter force from the object to be abraded. Therefore the consistent contact between the object and the abrasive disc surface is obtained. The finished surface has less abrasion trace and can be smoothened.

The stakes 7 to fasten the abrasive chips or the recess made in the suspension plate 4 firmly hold the abrasive chips against the strip off due to the shearing stress applied to the abrasive chips. Therefore the present invention supports high-speed abrasion in such high durability against the shearing stress. The flexibility of the disc substrate 2 assists such high durability and homogenous finish of the abraded surface of the objects.

The planner shape and arrangement of the abrasive chips such that radial line of the disc substrate is not dropped in the gaps between two adjacent abrasive chips generates less hits of the abrasive chip edges against the objects. Therefore the abrasive chips are hardly taken off from the disc substrate and less acoustic noise is generated in the abrasion, both of which are suitable for high-speed abrasion. The less hits of abrasive chip edges against the objects serves for clean finishing of abraded surfaces.

The declined surfaces of abrasive chip generate less mechanical shocks in the abrasion so that the life time of the abrasive chip can be long and the finish of the abraded surface can be clean.

According to multiple effects of abrasive chips, such as the loading weight per abrasive particle, the quantity of particles exposing to the object and exhaust speed of cuttings through the gaps between two adjacent abrasive chips, the abrasion performance against the quantity of the abrasive chips is determined.

By the combination of different kinds of abrasive discs, longer life of the abrasive discs is obtained though the abrasion speed is sacrificed.

Although the invention has been described in detail with reference to certain preferred embodiments, variations and modifications exist within the scope and spirit of the invention as described and detained in the following claims.

What is claimed is:

1. An abrasive disc comprising:

a disc substrate of flexible fiber reinforced resin having a substantially planar annular peripheral portion;

plural abrasive chips, each of said plural abrasive chips having an abrasive layer on a planar metal piece and being arranged in said peripheral portion of said disc substrate with a predetermined space;

an annular suspension plate interposed between said disc substrate and said plural abrasive chips, said annular suspension plate being in the form of a circular ring made of flexible metal; and an annular elastic sheet placed between said annular portion of said disc substrate and said suspension plate so as to isolate said disc substrate from said suspension plate in order to absorb mechanical shock generated in operation of said abrasive disc, said elastic sheet being in the form of a circular ring;

wherein metal stakes are integrally formed on one surface of said metal piece of each of said plural abrasive chips, wherein said suspension plate has through-holes through which said stakes are inserted, and wherein distal end portions of said stakes are deformed so as to clamp said metal pieces to said suspension plate in order to fasten said abrasive chips to said suspension plate.

2. The abrasive disc according to claim 1, wherein said disc substrate is formed into a saucer-shape of which outer portion forms said peripheral portion.

3. The abrasive disc according to claim 1, wherein said disc substrate has a supplemental plate which has a concentric shape and contacts to said disc substrate.

4. The abrasive disc according to claim 1, wherein said plural abrasive chips and said suspension plate have through-holes to which rivets are inserted and deformed therein.

5. The abrasive disc according to claim 1, wherein said suspension plate has recessed grooves to which said plural abrasive chips are buried.

6. The abrasive disc according to claim 5, wherein said recessed grooves have openings in peripherals of said suspension plate.

7. The abrasive disc according to claim 1, wherein said abrasive layer of each of said plural abrasive chips covers a top surface and declined surfaces on said metal piece.

8. The abrasive disc according to claim 7, wherein said declined surfaces of each of said plural abrasive chips are formed in an outer peripheral portion and an inner peripheral portion.

9. The abrasive disc according to claim 1, wherein eight to twelve pieces of said plural abrasive chips are attached to said disc substrate.

10. The abrasive disc according to claim 1, wherein said plural abrasive chips occupy a range of 50% to 90% area of a total area which is an annular area prescribed by a rotation trajectory of said plural abrasive chips.

11. The abrasive disc according to claim 1, wherein a pattern of said plural abrasive chips in a rotational plane thereof has such a configuration that a forward edge and a backward edge of each of said plural abrasive chips are both declined against a radial line which crosses both said forward edge and said backward edge of adjacent two abrasive chips.

12. The abrasive disc according to claim 1, wherein a diamond abrasive is fixed onto said metal piece with melting metal that has wettability with diamond.

13. The abrasive disc according to claim 1, wherein a diamond abrasive is fixed onto said metal piece with plating metal that has wettability with diamond.

14. The abrasive disc according to claim 1, wherein two kinds of diamond abrasive chips, a metal bond abrasive chip which is constructed with diamond abrasives which are fixed onto said metal piece with more than one biding metals that are sintered with diamond with high pressure and an activated metal bond abrasive which is constructed with diamond abrasives which are fixed onto said metal piece with activated biding metals that are sintered with diamond in a vacuum environment, are used for said plural abrasive chips.

15. The abrasive disc according to claim 14, wherein said metal bond abrasive chips are fabricated with metals including copper, tin, nickel and cobalt sintered in a reduction gas with high mechanical pressure and said activated metal bond abrasive chips are fabricated with titanium and chrome sintered in a vacuum environment.

16. The abrasive disc according to claim 15, wherein said metal bond abrasive chips are fabricated with further including a metal selected from a group of tungsten, silver and ion.

17. The abrasive disc according to claim 14, wherein said activated metal bond abrasion chips occupy 15% to 45% of annular area determined by trajectory of said activated metal bond abrasive chips in a revolution of said abrasive disc.

18. The abrasive disc according to claim 1, wherein said metal stakes and said metal piece of each of said plural abrasive chips are formed homogeneously as a single piece.

19. The abrasive disc according to claim 1, wherein the abrasive chips include a first abrasive chip circumferentially interposed between and adjacent to second and third abrasive chips, the first abrasive chip having a front edge spaced from yet radially overlapping a rear edge of the second abrasive chip, and the first abrasive chip further having a rear edge spaced from yet radially overlapping a front edge of the third abrasive chip.

* * * * *